US005127224A

United States Patent [19]

Barcza et al.

[11] Patent Number: 5,127,224

[45] Date of Patent: Jul. 7, 1992

[54] SPRAY-RING MOUNTING ASSEMBLY

[75] Inventors: W. Kevin Barcza, Stuart; Michael J. Concordia, Jupiter, both of Fla.

[73] Assignee: United Technologies Corporation, Hartford, Conn.

[21] Appl. No.: 673,927

[22] Filed: Mar. 25, 1991

[51] Int. Cl.[5] ..... F02K 3/10

[52] U.S. Cl. ..... 60/261; 403/61; 403/158; 411/400

[58] Field of Search ..... 60/261, 264, 749, 39.31, 60/39.32; 411/383, 400, 401; 403/57, 61, 157, 158

[56] References Cited

U.S. PATENT DOCUMENTS

| | | | |
|---|---|---|---|
| 1,213,819 | 1/1917 | Bearup | 403/57 |
| 3,295,325 | 1/1967 | Nelson | 60/261 |
| 3,768,251 | 10/1973 | Camboulives et al. | 60/749 |
| 4,139,245 | 2/1979 | McCloskey | 403/157 |
| 4,592,200 | 6/1986 | Benoist et al. | 60/261 |
| 4,724,671 | 2/1988 | Laperghe et al. | 60/261 |

*Primary Examiner*—Richard A. Bertsch

*Assistant Examiner*—Michael I. Kocharov

[57] ABSTRACT

An improved mounting assembly is arranged for use in a thrust augmentation combustor for a gas turbine engine, for mounting a spray ring or the like to a duct. The mounting assembly includes a clevis which is mounted to the duct and has a circular pin upon which is carried an elongated slider having an axial central circular bore. The slider is mounted for rotational movement on the pin and has at least two parallel exterior sidewalls. A bracket is mounted on the slider for connection to the spray ring and has an elongated bore through which the slider passes. The elongated bore is closely fitted to the slider exterior in a first dimension corresponding to the parallel sidewalls and is larger than the slider exterior in a second dimension. The elongated bore has a length which is less than the axial length of the slider so that the bracket can be translated axially along the slider and the slider can be translated in the rectangular bore in the second dimension. The bracket can also rotate with respect to the slider about an axis corresponding to the first dimension.

2 Claims, 5 Drawing Sheets

SPRAY-RING MOUNTING ASSEMBLY

The invention was made under a U.S. Government contract and the Government has rights herein.

BACKGROUND OF THE INVENTION

This invention relates to an assembly for mounting a spray ring or similar device to the duct in a thrust augmentation chamber for a gas turbine aircraft engine.

FIG. 1 is a modified cross-sectional diagram showing a known arrangement for a thrust augmentation combustor for a gas turbine aircraft engine wherein a chamber 10 is surrounded by a duct 12 within which there is provided a combustion liner 14. Spray rings 16 provide fuel to the augmentation combustor. It should be understood in the modified cross-sectional diagram of FIG. 1, only portions of parts immediately adjacent the central cross-section are shown, for simplicity. Fuel supplied by spray rings 16 is mixed into the by-pass air stream by flame holders 20 and ignited by igniting device 22. Spray ring 16 and flame holder 20 surround the tail cone 18 of the turbine portion of the engine.

According to known arrangements, as illustrated in FIG. 2, the fuel spray rings 16 are supported by mounting brackets as shown in FIG. 2. The bracket of FIG. 2 includes a mounting stud 26 for attachment to the peripheral duct 12 of the augmentation combustor. A clevis 24 is attached to the mounting stud 26 and arranged to receive a mounting bracket 28 for mounting the spray ring. Bracket 28 is mounted to clevis 24 by a bolt and pin arrangement whereby bracket 28 can pivot in one rotational direction with respect to clevis 24.

Studies in connection with the engine of FIG. 1 have indicated that augmentation combustion, combined with the operation of the turbine engine, can cause substantial vibrations in duct 12, which may be conducted to augmentation spray ring 16 by reason of the mounting arrangement of FIG. 2. In particular, the FIG. 2 mounting arrangement provides very limited vibration isolation between duct 12 and spray ring 16. Vibrational forces conveyed to spray ring 16 can cause premature failure of the spray ring by reason of resonant vibrations of spray ring 16 leading to structural failure.

It is therefore an object of the present invention to provide a new and improved spray ring mounting arrangement which provides increased isolation of duct vibrations from the spray ring.

SUMMARY OF THE INVENTION

In accordance with the present invention there is provided an assembly for mounting a spray ring in a thrust augmentation chamber for a gas turbine engine with improved vibration isolation characteristics. The arrangement includes a clevis arranged for fixed mounting to the duct of the engine. A circular pin is mounted in the clevis and accommodates an elongated slider having an axial central circular bore which is mounted for rotational movement on the pin. The slider has at least two parallel sidewalls. A bracket is provided for mounting the spray ring and having an elongated bore surrounding the slider. The bore is closely fitted to the parallel slider sidewalls in a first dimension and is larger than the slider exterior in a second dimension. The elongated bore has a length which is less than the axial length of the slider so that the bracket can be translated axially along the slider and the slider can be translated in the elongated bore in the second dimension. The bracket can also rotate with respect to the slider about an axis corresponding to the first dimension.

In a preferred arrangement the exterior cross-sectional profile of the slider is square.

For a better understanding of the present invention, together with other and further embodiments, reference is made to the following description, taken in conjunction with the accompanying drawings, and its scope will be pointed out in the appended claims.

DESCRIPTION OF THE PREFERRED EMBODIMENT

Figure 3:
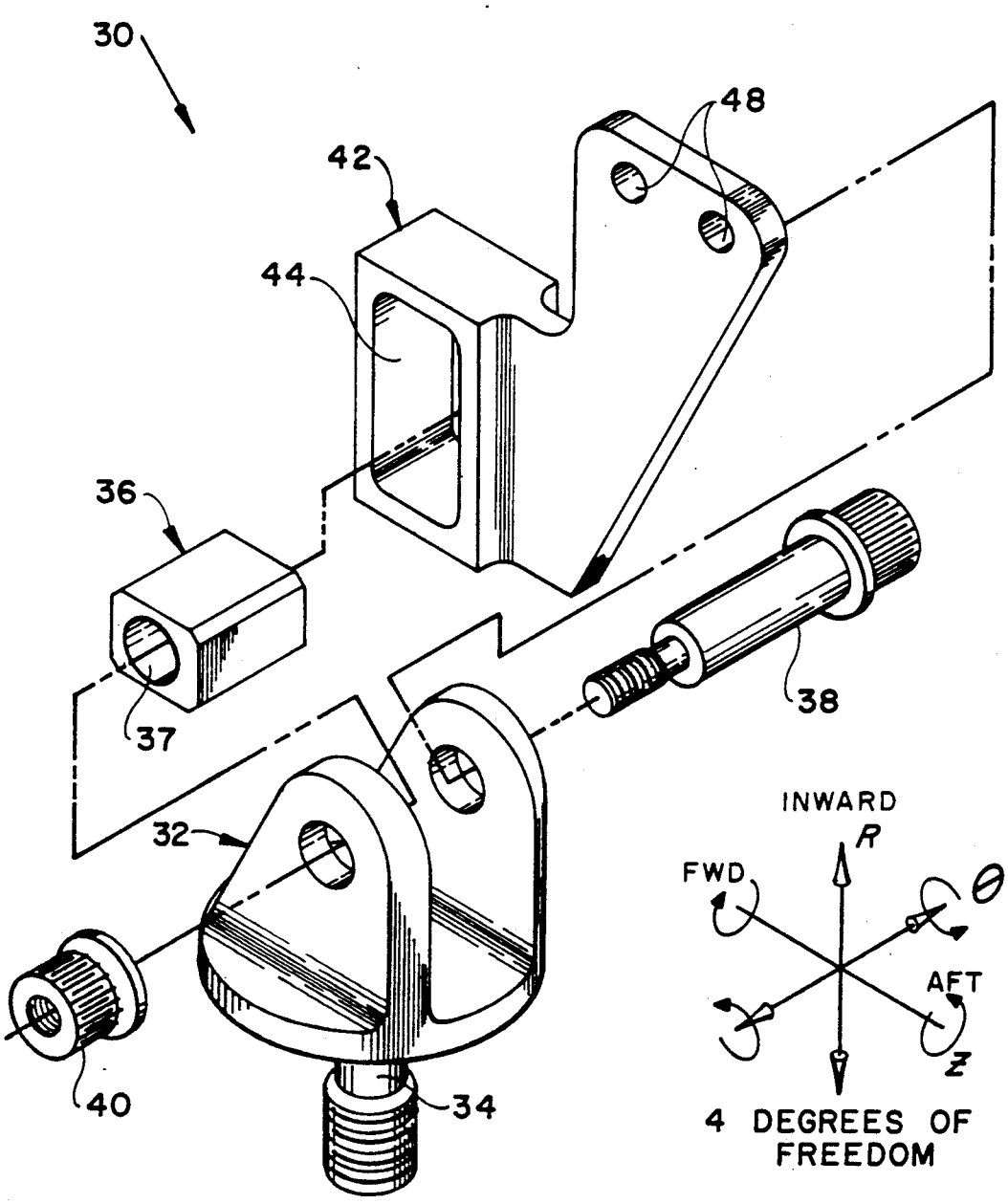
FIG. 3 is an exploded view of a mounting assembly for a spray ring of an augmentation combustor in accordance with the present invention.

As shown in FIG. 3, the mounting assembly of the present invention includes a clevis 32 having a bolt 34 arranged for mounting the clevis to the duct 12 of the augmentation combustion chamber 10 of a jet engine. A slider 36, which includes a central interior bore 37 and preferably a square or rectangular external cross-section, with at least two parallel sidewalls is arranged in clevis 32 and secured thereto by bolt 38 which passes through the cylindrical central bore 37 of slider 36 and is retained in position by nut 40. Bracket 42 includes a elongated, preferably rectangular, bore 44 which surrounds slider 36. In the horizontal dimension as shown in FIG. 3, elongated bore 44 is closely fitted to slider 36. In the vertical dimension as shown in FIG. 3, bore 44 is elongated with respect to the exterior cross-section of slider 36. Mounting bracket 42 further includes a mounting flange 46 for connection to a spray ring by the use of mounting holes 48 or similar arrangement.

Figure 1:
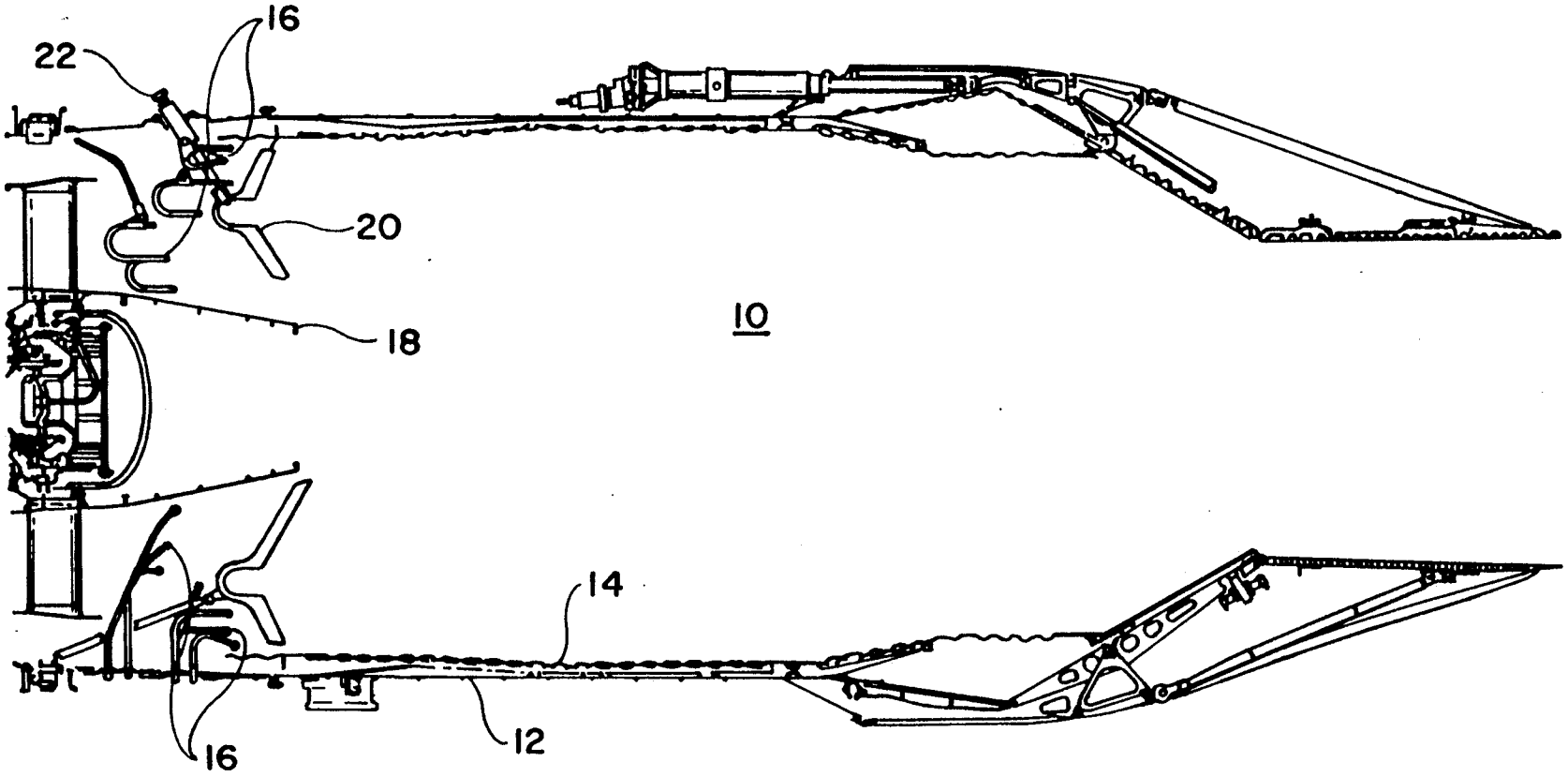
FIG. 1 (PRIOR ART)
FIG. 1 is a modified cross-sectional view of the augumentor section of a known gas turbine aircraft engine.
Figure 2:
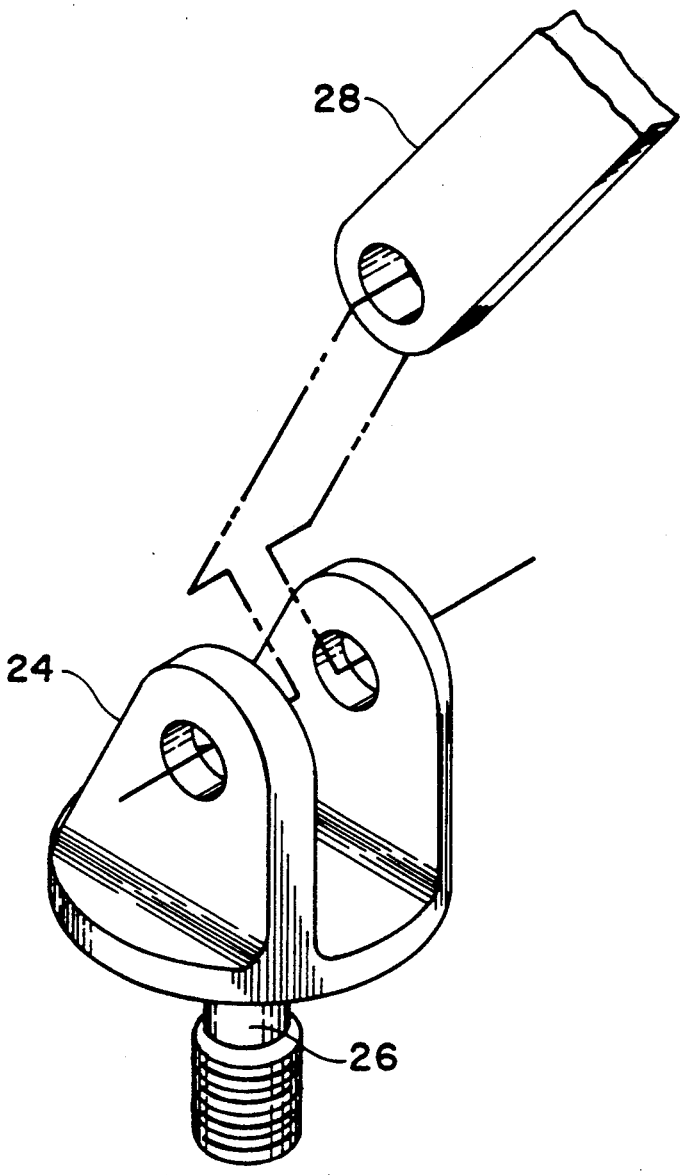
FIG. 2 (PRIOR ART)
FIG. 2 is a perspective view of a prior art mounting assembly for mounting the spray ring of the FIG. 1 engine.
Figure 4:
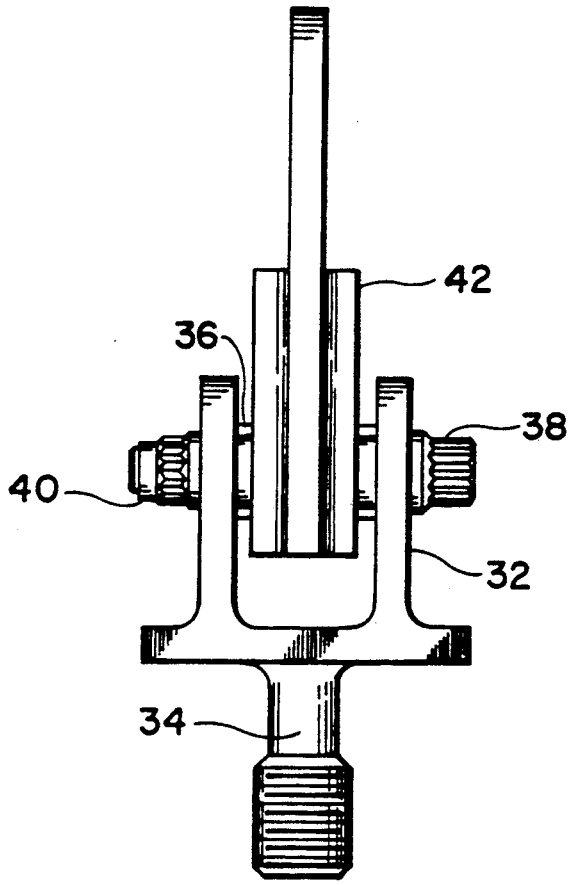
FIG. 4 is a plan view of the mounting assembly of the present invention.
Figure 5:
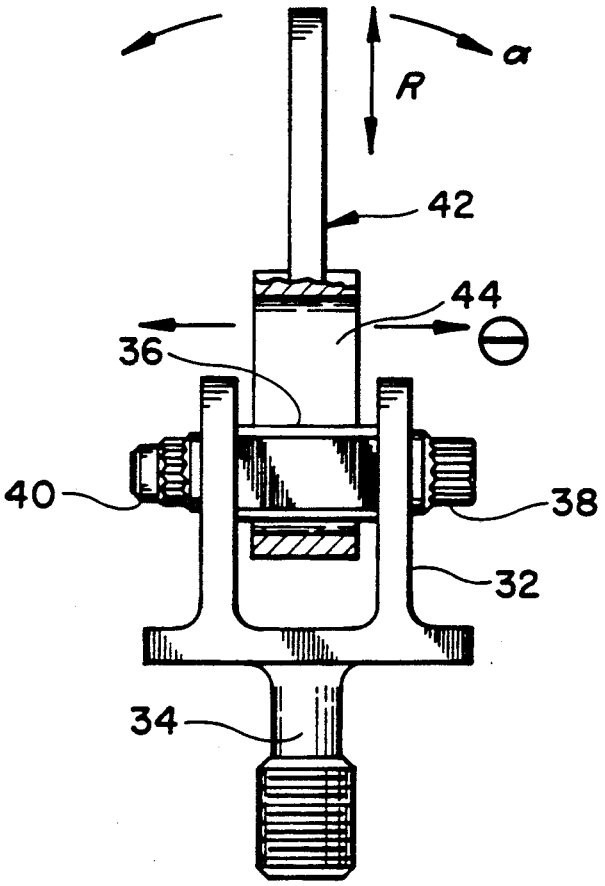
FIG. 5 is a partially cross-sectioned view of the mounting assembly according to the present invention.

The mounting arrangement of the present invention as shown in the exploded view of FIG. 3 or in the assembled views of FIGS. 4 and 5 provides 4 degrees of freedom for vibration isolation, as compared to a single degree of freedom for vibration isolation which is characteristic of the prior art mounting assembly shown in FIG. 2. In particular, the vertical movement of slider 36 within rectangular bore 44 of bracket 42 enables inward and outward movement of bracket 42 with respect to the duct to which clevis 32 is mounted. This movement is indicated by the arrow R of FIGS. 3 and 5, indicating radial movement with respect to the axis of the engine.

In addition, the provision of the round central bore 37 of slider 36, which is arranged to pivot on pin 38, enables the pivoting movement of bracket 46 about a circumferential axis theta shown in FIG. 3, corresponding to the single degree of freedom of the prior art mounting arrangement of FIG. 2.

Mounting bracket 42 can also slide horizontally in the drawing of FIG. 3 along the axis indicated as theta in FIGS. 3 and 5 and since the bore 44 of bracket 42 has a length which is less than the length if slider 36. This provides a second additional degree of freedom for vibration isolation. A third additional degree of freedom is provided by the pivoting of bracket 42 on slider 36 which is enabled by the fact that bore 44 is vertically longer than the vertical dimension of slider 36 and horizontally shorter than the axial length of slider 36 to enable pivoting along the angular direction alpha, shown in FIG. 5.

FIG. 3 includes a degree of freedom diagram showing that bracket 42 can translate in a radial direction R inward and outward with respect to the axis of the engine, can translate in a circumferential direction theta corresponding to the local theta axis of the engine and can rotate in an angular direction $\alpha$ about the Z axis and about the theta axis. Accordingly, the bracket of the present invention provides 4 degrees of freedom for vibration isolation between the augmentation combustor duct and the spray ring, thereby isolating the spray ring from vibrational forces in these various degrees of motion.

While each individual mounting bracket according to the present invention has 4 degrees of freedom as illustrated, the combination of 6 or 7 such mounting brackets in support of a single spray ring 16 in the augmentation combustor chamber 10 provides for secure mounting of the spray ring 16 within the chamber against normally encountered forces.

It is specifically intended that the terms rectangular and square with respect to the exterior shape of slider 36 and bore 44 are intended to convey the degrees of freedom of motion enabled by the configurations illustrated, and are not specifically intended to limit the actual shape of the elements used, for example, which may have rounded or cut off corners or may actually be of hexagonal, octagonal or other appropriate shape with at least two parallel sides to enable translational motion of slider 36 in one direction within bore 44 and limit translational motion in a transverse direction and also to permit translation and rotational motion of bracket 42 on slider 36.

We claim:

1. In a thrust augmentation combustor for a gas turbine engine having a duct, an assembly for mounting a spray ring or the like to said duct and having improved vibration isolation characteristics comprising:

a clevis arranged for fixed mounting to said duct, a circular pin mounted in said clevis, an elongated slider having a central circular axial bore and mounted for rotational movement on said pin, said slider having at least two parallel exterior sidewalls, and a bracket for mounting said spray ring having an elongated bore mounted on said slider, said elongated bore having parallel sidewalls closely fitted to said parallel sidewalls of said slider in a first dimension and being larger than the slider exterior in a second dimension, and said elongated bore having a length which is less than the axial length of said slider, whereby said bracket can be translated axially along said slider and said slider can be translated in said elongated bore in said second dimension and said bracket can rotate with respect to said slider about an axis corresponding to said first dimension.

2. A mounting assembly as specified in claim 1 wherein said slider has a square exterior axial cross section.

* * * * *